US007887646B2

(12) United States Patent
Nanba et al.

(10) Patent No.: US 7,887,646 B2
(45) Date of Patent: Feb. 15, 2011

(54) ORIENTED MAGNETIC STEEL PLATE EXCELLENT IN COATING ADHESION AND METHOD OF PRODUCTION OF SAME

(75) Inventors: Eiichi Nanba, Himeji (JP); Yuji Kubo, Futtsu (JP); Kazutoshi Takeda, Himeji (JP); Satoshi Arai, Himeji (JP); Hotaka Honma, Futtsu (JP); Kenichi Murakami, Futtsu (JP); Hideyuki Kobayashi, Himeji (JP)

(73) Assignee: Nippon Steel Corporation, Tokyo (JP)

( * ) Notice: Subject to any disclaimer, the term of this patent is extended or adjusted under 35 U.S.C. 154(b) by 436 days.

(21) Appl. No.: 11/920,591

(22) PCT Filed: May 19, 2006

(86) PCT No.: PCT/JP2006/310509

§ 371 (c)(1),
(2), (4) Date: Nov. 14, 2007

(87) PCT Pub. No.: WO2006/126660

PCT Pub. Date: Nov. 30, 2006

(65) Prior Publication Data

US 2009/0047537 A1 Feb. 19, 2009

(30) Foreign Application Priority Data

May 23, 2005 (JP) ..... 2005-149831

(51) Int. Cl.
*H01F 1/147* (2006.01)

(52) U.S. Cl. ..... 148/113; 148/111

(58) Field of Classification Search ..... None
See application file for complete search history.

(56) References Cited

U.S. PATENT DOCUMENTS 4,130,447 A * 12/1978 Marianeschi et al. ..... 148/27
4,579,608 A * 4/1986 Shimizu et al. ..... 148/111
5,885,371 A * 3/1999 Komatsubara et al. ..... 148/113
6,280,534 B1 * 8/2001 Senda et al. ..... 148/113
2002/0011278 A1 * 1/2002 Komatsubara et al. ..... 148/120

FOREIGN PATENT DOCUMENTS

| | | |
|---|---|---|
| JP | 40-015644 | 7/1965 |
| JP | 53-004714 | 1/1978 |
| JP | 55-018566 | 2/1980 |
| JP | 58-002569 | 1/1983 |
| JP | 60-002674 | 1/1985 |
| JP | 60-141830 | 7/1985 |
| JP | 61-015152 | 4/1986 |
| JP | 06-088171 | 3/1994 |
| JP | 06-145998 | 5/1994 |
| JP | 6-192743 A | 7/1994 |
| JP | 08-295937 | 11/1996 |
| JP | 09-118921 | 5/1997 |
| JP | 09-184017 | 7/1997 |
| JP | 9-256164 A | 9/1997 |
| JP | 2002-302718 A | 10/2002 |

OTHER PUBLICATIONS

European Search Report dated Sep. 24, 2009, issued in corresponding European Patent Application No. 06756609.1.
JIS 1256.

* cited by examiner

*Primary Examiner*—John P Sheehan
(74) *Attorney, Agent, or Firm*—Kenyon & Kenyon LLP

(57) ABSTRACT

The present invention provides oriented magnetic steel plate with excellent coating adhesion, in particular coating edge peeling resistance, that is, oriented magnetic steel plate with excellent coating adhesion containing, by mass %, Si: 1.8 to 7% and having a primary coating having forsterite as its main ingredient on its surface, said oriented magnetic steel plate characterized in that said primary coating contains one or more of Ce, La, Pr, Nd, Sc, and Y in an areal weight per side of 0.001 to 1000 mg/m$^2$; characterized in that said primary coating contains Ti in an areal weight per side of 1 to 800 mg/m$^2$; and characterized in that said primary coating contains one or more of Sr, Ca, and Ba in an areal weight per side of 0.01 to 100 mg/m$^2$.

3 Claims, No Drawings

ORIENTED MAGNETIC STEEL PLATE EXCELLENT IN COATING ADHESION AND METHOD OF PRODUCTION OF SAME

TECHNICAL FIELD

The present invention relates to oriented magnetic steel plate used in transformers or other stationary induction apparatuses etc. (hereinafter these referred to all together as simply "transformers"). In particular, it relates to an oriented magnetic steel plate excellent in coating adhesion, in particular edge peeling resistance and 3× frequency watt loss characteristic $W_{17/150}$, and thereby having excellent working characteristics and magnetic characteristics, by adding a compound including one or more elements of Ce, Lan, Pr, Nd, Sc, and Y into an annealing separator having MgO as its main ingredient, and a method of production of the same.

BACKGROUND ART

Oriented magnetic steel plate is mainly used for stationary induction apparatuses such as transformers. As characteristics to be satisfied, (1) a small energy loss, that is, watt loss, when excited by AC, (2) a high magnetic permeability and easy excitation in the excitation range used of equipment, (3) a small magnetostriction due to noise, etc. may be mentioned.

Regarding the watt loss, a transformer is continuously excited and energy loss continues to occur over a long period from installation to disposal, so this becomes an important parameter determining the TOC (total owning cost)—an indicator of the value of a transformer.

To reduce the watt loss of oriented magnetic steel plate, numerous technologies have been developed up to now. That is, there have been (1) raising the density of the {110}<001> orientation called the "Goss orientation", (2) raising the content of the Si and other solute elements for raising the electrical resistance, (3) reducing the plate thickness of the steel plate, (4) giving a ceramic coating or insulating coating giving surface tension to the steel plate, (5) reducing the size of the crystal grains, (6) introducing strain or grooves in a line form so as to divide the magnetic domains, etc. Regarding (6), Japanese Patent Publication (B2) No. 57-2252 discloses a method of lasering steel plate, while Japanese Patent Publication (B2) No. 58-2569 discloses a method of introducing mechanical strain in the steel plate, various methods of dividing the magnetic domains, and a material exhibiting superior watt loss characteristics.

On the other hand, for the magnetic permeability and magnetostriction, raising the orientation density of the crystal grains to the Goss orientation is effective. The magnetic flux density at the excitation force of 800 A/m, that is, $B_8$, is used as an indicator of that. As one of the typical technologies for improving the magnetic flux density, the method of production disclosed in Japanese Patent Publication (B2) No. 40-15644 may be mentioned. This is a method of production making AlN and MnS function as inhibitors inhibiting crystal grain growth and making the rolling ratio in the final cold rolling process a strong rolling ratio over 80%. Due to this method, the orientation density of the crystal grains in the {110}<001> orientation rises, and oriented magnetic steel plate having a high magnetic flux density of a $B_8$ of 1.870 T or more is obtained. Further, as technology for improving the magnetic flux density, for example, Japanese Patent Publication (A) No. 6-88171 discloses the method of adding, in addition to AlN and MnS, 100 to 5000 g/ton of Bi to the molten steel to obtain a product with a $B_8$ of 1.95 T or more. However, if using the method of using these Al-based inhibitors to raise the magnetic flux density, it is known that the adhesion of the primary coating having a forsterite coating as its main ingredient (hereinafter referred to simply as a "coating" in the present invention in some cases) particularly deteriorates.

In this regard, at the time of the final annealing of the oriented magnetic steel plate, usually an annealing separator having MgO as its main ingredient is used. Adding additives to these so as to improve the magnetic characteristics, coating adhesion, and other various characteristics of oriented magnetic steel plate has been proposed.

Japanese Patent Publication (A) No. 60-141830 discloses a method of production of oriented silicon steel plate adding to an annealing separator having MgO as its main ingredient one or more of additives selected from La, La compounds, Ce, and Ce compounds in a total weight as La and Ce compounds of 0.1 to 3.0% with respect to the MgO and adding S or S compounds in an amount as S with respect to the MgO of 0.01 to 1.0%.

This discovers that by ensuring the copresence of La and Ce with a strong affinity with S, the inhibitory action on the grain growth of primary recrystallization and the action of strictly controlling the orientation of the secondary recrystallized grains grown from the surface layer result in striking improvement of the magnetic characteristics. However, the steel slab ingredients described in that publication do not contain Al effective for realization of a high magnetic flux density. The effect of Al, which has a great effect on the adhesion of the primary coating, is not alluded to.

Further, Japanese Patent Publication (B2) No. 61-15152 discloses an annealing separator for grain-oriented silicon steel strip using magnesium oxide as a base material, said annealing separator characterized by including a rare earth oxide alone or together with a metal silicate. Further, this discloses that a product free from small discontinuities (recessed parts of small holes) below the skin of the strip is obtained and a low magnetostriction rate and good surface resistivity and adhesion are obtained. However, that publication does not touch upon the effects of deterioration of the adhesion of the primary coating seen in particular when using an Al-based inhibitor at all.

DISCLOSURE OF THE INVENTION

In the above way, the method of using in particular an Al-based inhibitor gave steel plate itself exhibiting excellent magnetic characteristics, but the problem of deterioration of the coating adhesion occurred. In particular, to use this steel plate to produce a transformer core, at the time of slit shearing and angular shearing, there is the problem of peeling of the coating in the vicinity of the sheared parts called "frame peeling". Solution of this has been awaited.

Further, in general, the watt loss of magnetic steel plate is measured by the method of using an Epstein measurement circuit as in JIS C2550 or using a single sheet measurement circuit as in JIS C2556. These measurement values and the measurement values of transformer cores fabricated by shearing and stacking this oriented magnetic steel plate differ. In general, the loss of the core becomes larger (the extent of this is called the "building factor BF"). When assembled in such a transformer, there is the problem that the watt loss characteristic of the steel plate itself cannot be sufficiently exhibited, that is, the building factor becomes larger. In the face of this, means for industrially manufacturing high efficiency transformers as sought by the market are being awaited.

The present invention solves the above problem and has as its gist the following:

(1) Oriented magnetic steel plate with excellent coating adhesion containing, by mass %, Si: 1.8 to 7% and having a primary coating having forsterite as its main ingredient on its surface, said oriented magnetic steel plate characterized in that said primary coating contains one or more of Ce, La, Pr, Nd, Sc, and Y in an areal weight per side of 0.001 to 1000 $mg/m^2$.

(2) Oriented magnetic steel plate as set forth in (1) characterized in that said primary coating contains Ti in an areal weight per side of 1 to 800 $mg/m^2$.

(3) Oriented magnetic steel plate as set forth in (1) or (2) characterized in that said primary coating contains one or more of Sr, Ca, and Ba in an areal weight per side of 0.01 to 100 $mg/m^2$.

(4) A method of production of oriented magnetic steel plate excellent in coating adhesion comprising producing oriented steel plate by a method including the series of steps of annealing oriented magnetic steel hot rolled plate comprising, by mass %, C, 0.10% or less, Si: 1.8 to 7%, Mn: 0.02 to 0.30%, a total of one or more of S and Se: 0.001 to 0.040%, acid soluble Al: 0.010 to 0.065%, N: 0.0030 to 0.0150%, and the balance of Fe and unavoidable impurities, cold rolling it one time or two times or more or two times or more with process annealing in between to finish it to the final plate thickness, next decarburization annealing it, then coating the steel plate surface with an annealing separator, drying it and final annealing it, during which using an annealing separator having MgO as a main ingredient and containing one or more of a Ce compound, La compound, Pr compound, Nd compound, Sc compound, and Y compound converted to metal in the range of 0.01 to 14 mass % with respect to MgO.

(5) A method of production of oriented magnetic steel plate excellent in coating adhesion as set forth in (4) characterized in that said annealing separator contains an Ti compound, converted to Ti, in a range of 0.5 to 10 mass % with respect to MgO.

(6) A method of production of oriented magnetic steel plate excellent in coating adhesion as set forth in (4) or (5) characterized in that said annealing separator contains one or more of compounds of Sr, Ca, and Ba, converted to metal, in a range of 0.1 to 10 mass % with respect to MgO.

(7) A method of production of oriented magnetic steel plate excellent in coating adhesion as set forth in (4) or (5) characterized in that said oriented magnetic steel hot rolled plate contains as a sub inhibitor Bi: 0.0005 to 0.05 mass % and/or one or more of Sn, Cu, Sb, As, Mo, Cr, P, Ni, B, Te, Pb, V, and Ge in 0.003 to 0.5 mass %.

(8) A method of production of oriented magnetic steel plate excellent in coating adhesion as set forth in (6) characterized in that said oriented magnetic steel hot rolled plate contains as a sub inhibitor Bi: 0.0005 to 0.05 mass % and/or one or more of Sn, Cu, Sb, As, Mo, Cr, P, Ni, B, Te, Pb, V, and Ge in 0.003 to 0.5 mass %.

As explained above, the present invention adds one or more compounds of Ce, La, Pr, Nd, Sc, and Y into the MgO so as to obtain oriented magnetic steel plate containing these in the primary coating by areal weights of fixed amounts and obtain oriented magnetic steel plate with good coating adhesion not obtainable by a conventional method of production, in particular, excellent later explained edge peeling resistance and 3× frequency watt loss $W_{17/150}$.

Here, "frame peeling" is peeling of the coating occurring in the vicinity of the sheared parts of magnetic steel plate. Oriented magnetic steel plate, when worked into a transformer, is sheared from an original coil of a width of about 1 m by a slitter in parallel to the rolling direction into a predetermined width and, in the case of a large sized stacked core transformer, is sheared at an angle of 45° with the rolling direction. These shearing operations are remarkably stronger operations compared with bending adhesion tests of several tens of mmϕ used as the general method of evaluation of the coating adhesion, so frame peeling occurs. "Edge peeling resistance" means the average width of the parts of coating peeled off from the sheared ends at the time of shearing. The edge peeling resistance should be 1 mm or less, preferably 0.5 mm or less, more preferably 0.1 mm or less. In the present invention, oriented magnetic steel plate with extremely good edge peeling resistance is obtained.

Further, the inventors discovered that if reducing the watt loss at 1.7 T and 150 Hz, that is, the 3× frequency watt loss $W_{17/150}$, the building factor can be reduced. Oriented magnetic steel plate is often used for power transformation under a three-phase alternating current, but not infrequently a single phase is used for general consumer electronics at the final site of consumption of power. Therefore, when designating the phases of the three phases as ϕ1, ϕ2, and ϕ3 and making the generating and consumed power exactly the same etc., ϕ1-ϕ2, ϕ2-ϕ3, and ϕ3-ϕ1 all become off by 120°, but for example often only the consumption of the ϕ1 phase ends up becoming large on a preferential basis. In this case, the ϕ1→ϕ2 and ϕ3 return currents become equal to the actual currents of the ϕ2 and ϕ3 phases, so a current bridging the phases must flow to cancel these out. When the basic frequency is 50 Hz, this cancellation current becomes the three times larger 150 Hz. That is, in three-phase AC operations for enabling the mass production and mass consumption of power by the maximum efficiency, there are quite a few situations where phase cancellation for each site is unavoidable in subdivided consumption sites. This is believed to be one factor obstructing the achievement of the theoretical energy efficiency.

According to the present invention, oriented magnetic steel plate with a low $W_{17/150}$ is obtained, so if using the magnetic steel plate of the present invention, a transformer core with a small building factor (close to 1) can be obtained.

BEST MODE FOR CARRYING OUT THE INVENTION

Next, the composition of ingredients of the oriented magnetic steel plate of the present invention and the method of production of same will be explained. Note that the amounts of the composition of ingredients are mass %.

Si is an element extremely effective for raising the electrical resistance of the steel and reducing the eddy current loss forming part of the watt loss, but if less than 1.8%, it is not possible to suppress the eddy current loss of the product. Further, if over 7.0%, the workability remarkably deteriorates, so this is not preferred. Further, to obtain a good watt loss and $W_{17/150}$, 2% or more, furthermore 3% or more, is preferable. When making the concentration of Si in the steel a high concentration such as 3% or more, the Young's modulus of the steel plate rises and the impact at the time of shearing becomes larger, so the edge peeling resistance particularly deteriorates, but this problem can be overcome by the present invention.

C, when exceeding 0.10%, is not preferable since not only does the required decarburization time become long in the decarburization annealing after the cold rolling, which is not economical, but also the decarburization easily becomes incomplete and the magnetic defect called "magnetic aging of the product" occurs. The lower limit value is preferably 0.025% or more from the viewpoint of suitable control of the primary recrystallization texture.

Mn is an important element forming MnS and/or MnSe, called inhibitors, governing the secondary recrystallization. If less than 0.02%, the absolute amount of MnS or MnSe required for causing secondary recrystallization becomes insufficient, so this is not preferred. Further, if over 0.3%, not only does entry into solid solution at the time of slab heating become difficult, but also the precipitation size at the time of hot rolling easily becomes coarser and the optimum size distribution as an inhibitor is damaged, so this is not preferable.

S and/or Se are important elements forming the above-mentioned MnS and/or MnSe together with M. If outside of the above range, a sufficient inhibitor effect cannot be obtained, so 0.001 to 0.040% is preferable.

Acid soluble Al is an element forming the main inhibitor for high magnetic flux density oriented magnetic steel plate. If less than 0.010%, the amount is insufficient and the inhibitor strength is insufficient, so this is not preferred. On the other hand, if over 0.065%, the AlN precipitating as an inhibitor becomes coarse and as a result the inhibitor strength is lowered, so this is not preferred.

N is an important element forming AlN with the above-mentioned acid soluble Al. If outside the above range, a sufficient inhibitor effect is not obtained, so the amount has to be limited to 0.0030 to 0.0150%. Note that N can also be added to the steel by a nitridation step after decarburization annealing.

Bi is an extremely useful element in the stable production of oriented magnetic steel plate with a superhigh magnetic flux density. If less than 0.0005%, the effect is not sufficiently obtained. Further, if over 0.05%, not only is the effect of improvement of the magnetic flux density saturated, but also cracks occur at the ends of the hot rolled coil.

In addition, as elements for stabilizing the secondary recrystallization or other purposes, it is also effective to include one or more of Sn, Cu, Sb, As, Mo, Cr, P, Ni, B, Te, Pb, V, and Ge in an amount of 0.003 to 0.5%. As the amounts of these elements added, if less than 0.003%, the effect of stabilization of secondary recrystallization is not sufficient, while if over 0.5%, the effect is saturated, so the amount is limited to 0.5% from the viewpoint of cost.

The molten steel for producing the oriented magnetic steel plate adjusted in ingredients as explained above is cast by the usual method, but is not particularly limited in casting method. Continuous casting or blooming is possible. The slab usually has an initial thickness of 150 mm to 300 mm in range, but may be a thin slab of 30 mm to 70 mm or so. Next, the slab is rolled by the usual hot rolling to a hot rolled coil. Usually, to make the MnS and AlN inhibitor ingredients sufficiently enter into solid solution, the slab is heated at a high temperature over 1300° C., but to give priority to the productively and cost, making the slab heating temperature about 1250° C. and performing the slab heating the same as ordinary steel when using a nitridation process from the outside in the state of a steel plate so as to strengthen the inhibitor in a later process are not detrimental to the idea of the present invention. Due to the above, oriented magnetic steel hot rolled plate is obtained.

Next, annealing the hot rolled plate, then performing final cold rolling, performing cold rolling a number of times including process annealing, or annealing the hot rolled plate, then performing cold rolling a number of times including process annealing may be used to finish the steel to the product plate thickness, but with annealing before final cold rolling, the crystal structure becomes homogeneous and the precipitation of AlN is controlled.

The strip rolled to the final product thickness is treated by decarburization annealing. The decarburization annealing, as is usually performed, uses heat treatment in wet hydrogen to reduce the C in the steel plate down to the region free from magnetic aging deterioration of the product plate and simultaneously causes primary recrystallization of the cold rolled strip and prepares for secondary recrystallization. Before this decarburization annealing, as earlier disclosed in Japanese Patent Publication (A) No. 8-295937 and Japanese Patent Publication (A) No. 9-118921, causing recrystallization at a heating rate of 80° C./sec or more to 700° C. or more also improves the watt loss, so is preferable. Further, when using a nitride-based acquired inhibitor, the nitridation is performed after this decarburization annealing.

Furthermore, final annealing is performed raising the temperature to 1100° C. or more for the purpose of formation of the primary coating, secondary recrystallization, and purification. This final annealing is performed in the form of a coil of a wound up strip. The steel plate surface is then coated with MgO powder for the purpose of preventing seizure of the strip and formation of a primary coating. MgO powder is generally coated and dried on the steel plate surface in the state of an aqueous slurry, but the electrostatic coating method may also be used.

This MgO powder including one or more of a Ce compound, La compound, Pr compound, Nd compound, Sc compound, and Y compound, converted to Ce or other metal, in an amount of 0.01 to 14 mass % with respect to MgO is one of the embodiments of the present invention. Due to this method, oriented magnetic steel plate with excellent edge peeling resistance and $W_{17/150}$ is obtained. If the amount added, converted to metal, is less than 0.01 mass %, sufficient edge peeling resistance is not obtained. Further, if over 14 mass %, a good $W_{17/150}$ is not obtained. Therefore, the amount is limited to this range. The amount of Ce etc. may be, converted to metal, 0.02, 0.03, 0.04, 0.05 mass % or an amount over that; 0.3, 0.4, or 0.5; or furthermore 3, 3.5, 4, 4.5, 5, 5.5, or 6 mass % or an amount over that. On the other hand, the amount may also be made 10, 9, 8, 7, 6, 5, or 4 mass % or an amount less than that.

As Ce compounds, there are $CeO_2$, $Ce_2O_3$, $Ce_2S_3$, $Ce(SO_4)_2.nH_2O$ (n is a number of 0 or more), $Ce_2(SO_4)_3.nH_2O$ (n is a number of 0 or more), $CeSi_2$, $CePO_4$, $Ce(OH)_4$, $Ce_2(CO_3)_3$, $CeB_6$, $CeCl_3$, $CeF_4$, $CeBr_3$, etc. As La compounds, there are $La_2O_3$, $La_2(SO_4)_3.nH_2O$ (n is a number of 0 or more), $La(NO_3)_3$, $La_2(CO_3)_3$, $LaCl_3$, etc., as Pr compounds, there are $Pr_6O_{11}$, $Pr(NO_3)_3$, $PrCl_3$, etc., as Nd compounds, there are $Nd_2O_3$, $Nd(NO_3)_3$, $Nd_2(CO_3)_3$, $NdCl_3$, etc., as Sc compounds, $Sc_2O_3$, $Sc(NO_3)_3$, $Sc_2(SO_4)_3$, etc., as Y compounds, there are $Y_2O_3$, $YCl_3$, $Y_2(CO_3)_3$, $Y(NO_3)_3$, $YF_3$, $Y_2(SO_4)_3$, etc. These compounds may also be in the form of oxides, sulfides, sulfates, silicides, phosphates, hydroxides, carbonates, borides, chlorides, fluorides, bromides, etc. or may be used as combinations of the same, but from the viewpoint of the cost and effect, oxides and hydroxides are preferable.

Ce, La, Pr, Nd, and Y have large atomic weights. Their compounds are large in density, so tend to precipitate in aqueous slurry. If precipitating, a drop in yield or a deviation in the composition of the annealing separator is easily caused, so problems arise in operation. To suppress these problems, the additive has to be uniformly dispersed in the aqueous slurry and precipitation suppressed, so these compounds preferably have as small a grain size as possible. In mesh notation, a 1000 mesh or less is preferable. However, a mesh is affected by the wire diameter of the screen and is inaccurate, so if indicated by mean grain size, 0.1 to 25 μm in range is preferable. More preferably it is 0.1 to 15 μm in range. The "mean grain size" spoken of here corresponds to the so-called secondary grain size of the grain size in the powder state of the additive. When the original grain size, that is, the primary grain size, is very small, the grains agglomerate and form secondary grains. The size of these secondary grains becomes important in operations. There are various methods of measurement of the mean grain size, but for example the laser diffraction scattering method may also be used for measurement.

Further, to maintain a high reactivity, the surface area has to be large, that is, the primary grain size must be fine. The indicator, that is, the BET specific surface area, is preferably 0.1 to 500 $m^2/g$. More preferably, it is 1 to 300 $m^2/g$, still more preferably 5 to 200 $m^2/g$ in range.

Note that it is also possible to mix grains of other grain sizes to grains of the mean grain size for use.

Further, if adding Ti compounds, converted to Ti, in an amount of 0.5 to 10 mass % in range with respect to the MgO to the annealing separator, the coating adhesion is further improved. If the amount added, converted to Ti, is less than 0.5 mass %, the contribution to the improvement of the edge peeling resistance is small, while if over 10 mass %, the watt loss characteristics of the product plate deteriorate, so the amount of addition of the Ti compounds was limited to this range. As types of Ti compounds, there are $TiO_2$, $Ti_3O_5$, $Ti_2O_3$, TiO, TiC, TiN, $TiB_2$, $TiSi_2$, etc., but from the viewpoint of the cost and effect, oxides are preferable. Converted to Ti, preferably the content is 1 to 8 mass %, more preferably 2 to 6 mass %.

Furthermore, including one or more compounds of Sr, Ca, and Ba in the annealing separator would also be effective for improvement of the edge peeling resistance. These compounds may also be in the form of oxides, hydroxides, sulfates, carbonates, nitrates, silicates, phosphates, etc. However, sulfates and sulfides are preferable as forms for the purposes of lowering the specific gravity to avoid precipitation when coating the annealing separator as an aqueous slurry and furthermore suppressing the dissolution in water and coating without loss are preferable.

Further, as the preferable contents of the compounds, if the total of these elements is, converted to mass %, 0.1% or less with respect to MgO, there is little contribution to the improvement of the edge peeling resistance. Further, if over 10%, conversely the coating is degraded, so the content was limited to 0.1 to 10%. Further, if considering the magnetic characteristics, the content is preferably 0.5 to 10%, more preferably 1 to 5%. Further, it is also possible to add halogens or other known additives to these.

In the final annealing, to remove the moisture in the MgO, it is preferable to provide a dewatering process holding the plate at a low temperature of 800° C. or less in a reducing atmosphere of a concentration of $H_2$ of 20% or more before the secondary recrystallization annealing.

The above method of production was explained with reference to the case of use of an inhibitor, but it is also possible to obtain the oriented magnetic steel plate of the present invention by applying the above Ce, La, Pr, Nd, Sc, Y, etc. to the annealing separator used in the case of a method of production not using an inhibitor.

Note that, as already explained, Japanese Patent Publication (A) No. 60-141830 discloses a method of production of oriented silicon steel plate using inhibitors comprised of La, Ce to which S or S compounds are added in amounts as S of 0.01 to 1.0% with respect to the MgO, but the effect on the edge peeling resistance and $W_{17/150}$ of the present invention does not depend on the S or S compounds. In actuality, the patent publication states that "when the amount, converted to S, is less than 0.01% or more than 1% with respect to MgO, the effect of improvement of the magnetic characteristics due to the addition of S is not recognized" (same patent publication, page 3, bottom left column, lines 7 to 10), but the effect of the present invention is obtained even when the amount, converted to S, is less than 0.01% or over 1% with respect to the MgO.

In most cases, after the final annealing, the primary coating is further given an insulating coating. In particular, the insulating coating obtained by coating and baking a coating solution having a phosphate and colloidal silica as main ingredients on the steel plate surface is effective for giving a large tension to the steel plate and further improving the watt loss.

Furthermore, in accordance with need, the above oriented magnetic steel plate is preferably lasered, irradiated with plasma, grooved by gear-shaped rolls or etching, or otherwise divided in magnetic domain sub divisions.

Due to the above, oriented magnetic steel plate having a primary coating having forsterite as its main ingredient and with excellent edge peeling resistance and/or $W_{17/150}$ is obtained.

Note that in evaluation of conventional coating adhesion, a coating able to withstand the peeling behavior in stationary working such as peeling by adhesive tape was sufficient, but if evaluating the edge peeling resistance like in the present invention, a coating able to withstand the peeling behavior in dynamic working able to withstand the impact at the time of shearing is necessary. That is, in addition to strong adhesion at the interface of the coating and base iron, good coating toughness is required. In particular, when steel contains Al, Al diffuses in the steel surface during the final annealing and reacts with the forsterite to form an Al composite oxide like $MgAl_2O_4$ at the bottom of the primary coating. The vicinity of the interface of the Al composite oxide and forsterite easily becomes a starting point of peeling or breakage and tends to remarkably lower the adhesion or edge peeling resistance of the primary coating. The reason why addition of compounds of Ce, La, Pr, Nd, Y, or Sc in MgO improves the edge peeling resistance is not certain, but the contribution to interfacial adhesion may be considered.

That is, the addition of these compounds is believed to cause growth of a wedge structure at the interface with the primary coating and make peeling of the coating difficult as a mechanical effect and remarkably improve the interfacial adhesion by the formation of strong bonds due to the added elements entering the interfaces as a chemical effect. When trapping the formed primary coating by electrolytic extraction and analyzing it by EPMA analysis (electron probe X-ray microanalysis), the copresence of the Ce or other additive metals with the copresent substance of Al was confirmed. The formation by Ce etc. of composite oxides with Al and further Mg or Si has a high possibility of changing the coating physical properties and interface physical properties.

Further, the effect of the primary coating on the dynamic physical properties may be considered. That is, it is guessed that the metal ingredients of these compounds control the crystal growth of the forsterite or sinterability or fine amounts of metal ingredients enter the forsterite and cause changes in the bonded state etc. to cause an effect of improvement of the toughness of the coating and enable the primary coating to withstand impact. The toughness of the ceramic is usually evaluated from the length of the cracks proceeding from the vertexes of the bottom sides of the pressure marks of a four-sided weight formed when pushing in a Vicker's probe by a certain load, but similar evaluation with a thin ceramic coating is difficult. However, in general, if the hardness is high, there is a greater tendency toward brittleness, so the penetration depth when pushing a probe of a three-sided weight or four-sided weight by a slight load or the magnitude of the hardness of the coating obtained from the pressure mark area may be used to obtain a grasp of the tendency of toughness of the coating. Further, it is necessary to consider the pushing load so as not to affect the substrate at that time. Further, compounds of Ce, La, Pr, Nd, Y, and Sc have the advantage that they enable such improvement of the primary coating, but do not cause phenomena causing deterioration of the watt loss such as diffusion into the steel, formation of precipitates in the steel, etc.

The effect of addition of a Ti compound, through copresence with Ce, La, Pr, Nd, Y, and Sc compounds, is predicted to be to accelerate the reduction of these compounds and thereby accelerate the above mechanism.

Further, the effects of copresence due to the addition of Sr, Ca, and Ba compounds are to make these metals diffuse in the inside layers of the decarburized film during the final annealing to form Si oxides containing Sr, Ca, and Ba and stable at a low oxygen potential so as to make the formation of the interfacial wedge structure more stable, promote the reduction of Ce and other compounds in the same way as Ti compounds, form Ce and other composite oxides to make the physical properties of the primary coating better, etc.

As in the present invention, it was learned that by including certain amounts of one or more of Ce, La, Pr, Nd, Sc, and Y in the forsterite-based primary coating of oriented magnetic steel plate containing Si in an amount of 1.8 to 7%, not only the above edge peeling resistance, but also the $W_{17/150}$ can be improved. The reason why the addition of Ce or the like causes the value of the $W_{17/150}$ to become smaller is not necessarily clear, but it is believed that by adding the additives prescribed in the present invention into the annealing separator, the form/physical properties of the primary coating change and the behavior of magnetic wall motion in the magnetization process is affected.

Here, the "areal weight" of an element in the primary coating means the amount of the element in the primary coating at one side per unit area of the steel plate. There are several methods for measurement of Ce, La, Pr, Nd, Sc, and Y, but two basic types of measurement methods will be explained. One is the fluorescent X-ray analysis method.

The Ce, La, Pr, Nd, Sc, and Y in the primary coating are measured by utilizing the fluorescent X-ray analysis method for a material coated with an insulating coating from which the insulating coating is removed by immersion in NaOH or another alkali aqueous solution or a material before coating with an insulating coating. For example, a fluorescent X-ray analyzer ZSX-100e made by Rigaku is used to irradiate samples with X-rays under conditions of 60 kV and 60 mA and measure the characteristic X-rays of the metal elements, that is, the La-rays etc. for peak intensity. Another method is the chemical analysis method.

This comprises dissolving the magnetic steel in the state containing the coating by for example aqua regia, then dissolving the undissolved residue by a mixed solution of fluoric acid and sulfuric acid, combining the same for complete dissolution, and measuring the dissolved solution by ICP (Inductively-Coupled Plasma) spectroanalysis or ICP-MS. For measurement of the Ce etc., the sensitivity of the ICP is not necessarily high. The method of using fluorescent X-ray analysis is more preferable.

Next, the method of quantification will be explained taking as an example Ce. In the case of fluorescent X-ray analysis, when using the above-mentioned method to measure the intensity of the Lα-rays of the Ce, for example, after integration for 40 seconds or another fixed time, background correction is performed and an integrated peak intensity is found. When the amount is small and the peak intensity is small, the integration time may be suitably increased. The areal weight is found from the comparison of this peak strength value with a predetermined calibration line. The calibration line is prepared, for example, by using cerium sulfate, ammonium cerium nitrate, or other such water-soluble compounds to prepare various concentrations of standard aqueous solutions, using magnetic steel plate having a primary coating not containing Ce as the substrate, dropping a certain amount if the solution or dipping the plate in the same, and analyzing the plate by fluorescent X-ray analysis. Here, a primary coating is used for the purpose of easing the matrix effect in fluorescent X-ray analysis, but when dropped on a Si substrate, a large difference is not seen in the case of impregnation of filter paper. Further, it is possible to fabricate a calibration line using samples for which the areal weights have been calculated in advance by the chemical analysis described below. In the case of chemical analysis, first, a certain area or certain mass of the magnetic steel plate with the primary coating is dissolved and the masses of the measured elements are found using ICP etc., then magnetic steel plate from which the primary coating has been removed by mechanical polishing or pickling etc. is similarly dissolved and the masses of the measured elements are found. From the difference, the areal weight per unit area of the primary coating is calculated.

If the areal weight of the Ce, La, Pr, Nd, Sc, or Y in this primary coating is less than 0.001 mg/m$^2$, the effect of improvement of the edge peeling resistance is not sufficient or the effect of improvement of the $W_{17/150}$ is not seen. On the other hand, if over 1000 mg/m$^2$, the $W_{17/150}$ deteriorates and the formation of the coating is conversely obstructed. The range of the areal weight of the Ce, La, Pr, Nd, Sc, or Y is more preferably 0.005 to 100 mg/m$^2$, more preferably 0.01 to 50 mg/m$^2$. The weight is more preferably 0.1 to 50 mg/m$^2$. The weight is most preferably 0.1 to 10 mg/m$^2$.

To control the areal weights of these elements in this range, as explained above, there is the method of including compounds of these elements in the annealing separator, but in addition to the contents of these elements in the annealing separator, the absolute amount of coating or the position in the coil where a difference occurs in the atmosphere directly above the steel plate in the case of annealing in a coil state etc. also have an effect. Therefore, the method of incorporating these elements into the steel ingredients in advance is also effective.

To improve the edge peeling resistance and $W_{17/150}$, the areal weight of the Ti in the primary coating is more preferably made 1 to 800 mg/m$^2$. The method of measurement of the Ti areal weight is similar to the above-mentioned method of measurement of the Ce areal weight. If making the Ti areal weight less than 1 mg/m$^2$, a remarkable edge peeling resistance is not obtained, while if over 800 mg/m$^2$, the watt loss deteriorates. The range of the Ti areal weight is preferably 3 to 500 mg/m$^2$, more preferably 10 to 500 mg/m$^2$, still more preferably 30 to 200 mg/m$^2$.

Controlling the areal weights of the Sr, Ca, and Ba in the primary coating is also effective for improving the edge peeling resistance and $W_{17/150}$. By making the areal weight of these elements, in total of one or more, 0.01 to 100 mg/m$^2$, the edge peeling resistance is improved. If less than 0.01 mg/m$^2$, a remarkable improvement is not obtained, while if over 100 mg/m$^2$, the properties of the coating deteriorate. The range of the areal weight is preferably 0.1 to 100 mg/m$^2$, more preferably 1 to 50 mg/m$^2$.

To improve the watt loss and $W_{17/150}$, the thickness of the steel plate is less than 0.30 mm, more preferably less than 0.27 mm, further preferably less than 0.23 mm. Further, when the thickness of the steel plate is Ts (mm) and the average film thickness of the primary coating is Tf (μm), Tf/Ts is preferably 0.1 to 20 in range. If smaller than 0.1, the coating tension is small, so the watt loss and 3× frequency watt loss deteriorate. If over 20, the ratio of the nonmagnetic layers becomes greater, so the rate of occupancy when producing a transformer falls and the edge peeling resistance falls. More preferably, the ratio is made 0.2 to 10, more preferably 0.5 to 10, more preferably 2 to 10, still more preferably 2 to 5 in range.

EXAMPLES

Example 1

A steel slab comprising, by mass %, C: 0.077%, Si: 3.2%, Mn: 0.075%, S: 0.025%, acid soluble Al: 0.025%, N: 0.008%, Sn: 0.1%, Cu: 0.1%, Bi: 0.0030%, and the balance of Fe was heated at 1350° C., then hot rolled to a thickness of 2.5 mm. The hot rolled plate was then annealed at 1120° C. for 1 minute. After this, the plate was cold rolled to a final plate thickness of 0.27 mm and was decarburization annealed in wet hydrogen at 840° C. for 2 minutes. After this, it was coated with an annealing separator comprising MgO to which the additives shown in Table 1 were added in the amounts of addition there (mass % of metal ingredients with respect to mass of MgO) and annealed at a high temperature at a maximum peak temperature of 1200° C. for 20 hours in a hydrogen gas atmosphere. The characteristics of the obtained product plates are shown in Table 2. Further, the X shown in Table 1 and 2 means a type of metal of an additive substance other than MgO, Ce, and Ti.

Due to this, oriented magnetic steel plate with excellent coating adhesion having a primary coating having forsterite as its main ingredient, in particular, edge peeling resistance, and $W_{17/150}$ is obtained.

TABLE 1

| | Additive ingredient | | | | | |
|---|---|---|---|---|---|---|
| Sample no. | Ce-based ingredient | Am't of Ce added (%) | Ti-based ingredient | Am't of Ti added (%) | X-based ingredient | Am't of X added (%) |
| 1 | $CeO_2$ | 0 | None | 0 | None | 0 |
| 2 | $CeO_2$ | 1 | None | 0 | None | 0 |
| 3 | $CeO_2$ | 3 | None | 0 | None | 0 |
| 4 | $CeO_2$ | 10 | None | 0 | None | 0 |
| 5 | $CeO_2$ | 15 | None | 0 | None | 0 |
| 6 | $Ce(OH)_4$ | 0.1 | $TiO_2$ | 5 | None | 0 |
| 7 | $Ce(OH)_4$ | 1 | $TiO_2$ | 2 | None | 0 |
| 8 | $Ce(OH)_4$ | 2 | $TiO_2$ | 10 | None | 0 |
| 9 | $Ce(OH)_4$ | 5 | $TiO_2$ | 0.5 | None | 0 |
| 10 | $Ce(OH)_4$ | 8 | $TiO_2$ | 8 | $La_2O_3$ | 1 |
| 11 | $Ce(SO_4)_2 \cdot 4H_2O$ | 0.2 | $TiO_2$ | 1 | $Sr(OH)_2$ | 1 |
| 12 | $Ce(SO_4)_2 \cdot 4H_2O$ | 1 | $TiO_2$ | 2 | $SrSO_4$ | 0.1 |
| 13 | $Ce(SO_4)_2 \cdot 4H_2O$ | 35 | $TiO_2$ | 2 | $Ba(OH)_2$ | 2 |
| 14 | $Ce(SO_4)_2 \cdot 4H_2O$ | 5 | $TiO_2$ | 5 | $BaSO_4$ | 0.1 |
| 15 | $Ce(SO_4)_2 \cdot 4H_2O$ | 5 | $TiO_2$ | 0.5 | $Y_2O_3$ | 5 |
| 16 | $Ce(SO_4)_2 \cdot 4H_2O$ | 10 | $TiO_2$ | 8 | $Sc_2O_3$ | 3 |

TABLE 2

| Sample no. | Ce areal weight ($mg/m^2$) | Ti areal weight ($mg/m^2$) | X areal weight ($mg/m^2$) | Watt loss $W_{17/50}$ (W/kg) | Watt loss $W_{17/150}$ (W/kg) | Edge peeling resistance (mm) | Remarks |
|---|---|---|---|---|---|---|---|
| 1 | 0 | 0 | 0 | 0.90 | 5.93 | 3 | Comp. ex. |
| 2 | 0.02 | 0 | 0 | 0.89 | 5.45 | 0 | Inv. |
| 3 | 10 | 0 | 0 | 0.88 | 5.30 | 0.2 | Inv. |
| 4 | 900 | 0 | 0 | 0.89 | 5.43 | 0.2 | Inv. |
| 5 | 1100 | 0 | 0 | 0.90 | 5.89 | 2 | Comp. ex. |
| 6 | 0.01 | 150 | 0 | 0.89 | 5.45 | 0.5 | Inv. |
| 7 | 2 | 65 | 0 | 0.88 | 5.29 | 0 | Inv. |
| 8 | 8 | 780 | 0 | 0.88 | 5.29 | 0 | Inv. |
| 9 | 0.6 | 32 | 0 | 0.89 | 5.41 | 0.2 | Inv. |
| 10 | 250 | 200 | 2 | 0.89 | 5.41 | 0.3 | Inv. |
| 11 | 0.1 | 46 | 35 | 0.89 | 5.40 | 0.1 | Inv. |
| 12 | 3 | 74 | 1 | 0.88 | 5.31 | 0.1 | Inv. |
| 13 | 1200 | 78 | 10 | 0.91 | 5.95 | 5 | Comp. ex. |
| 14 | 48 | 145 | 0.5 | 0.89 | 5.46 | 0.7 | Inv. |
| 15 | 120 | 42 | 45 | 0.89 | 5.48 | 0.1 | Inv. |
| 16 | 170 | 530 | 30 | 0.89 | 5.50 | 0.1 | Inv. |

Example 2

A steel slab containing the chemical ingredients shown in Table 3 was hot rolled to a thickness of 1.3 mm. The hot rolled steel plate was annealed at 1100° C. for 1 minute. After this, it was rolled by cold rolling to a final plate thickness of 0.23 mm.

Furthermore, the obtained strip was raised in temperature to 850° C. by the 300° C./s electric heating method, then was decarburization annealed at a uniform temperature of 820° C. in wet hydrogen. An annealing separator having MgO as its main ingredient, containing $TiO_2$, converted to Ti, in an amount of 3% and of a mean grain size of 3 μm (measured by SALD-3000S made by Shimadzu), and containing $Ce(OH)_4$ of a BET specific surface area of 190 $m^2/g$ (measured by Micrometrics FlowSorbII 2300 made by Shimadzu) in an amount, converted to Ce, with respect to MgO shown in Table 4, was coated, then the strip was treated to remove the moisture in the MgO at 700° C.×20 h, then annealed at a high temperature at 1200° C. for 20 hours in a hydrogen gas atmosphere. The excess MgO of the obtained steel plate was removed, then the formed forsterite coating was formed with an insulating coating having colloidal silica and a phosphate as its main ingredients to obtain the final product. The characteristics of the obtained product are shown in Table 4.

A coil satisfying the conditions of the present invention forms oriented magnetic steel plate with excellent coating adhesion, edge peeling resistance, and magnetic characteristics.

TABLE 3

| Chemical ingredients (mass %) | | | | | | | |
|---|---|---|---|---|---|---|---|
| C | Si | Mn | S | sol. Al | N | Sn | Bi |
| 0.084 | 3.40 | 0.080 | 0.025 | 0.028 | 0.0080 | 0.120 | 0.0033 |

TABLE 4

| Am't of Ce added (%) | Ce areal weight ($mg/m^2$) | Watt loss $W_{17/50}$ (W/kg) | Watt loss $W_{17/150}$ (W/kg) | Edge peeling resistance (mm) | Remarks |
|---|---|---|---|---|---|
| 0 | 0 | 0.85 | 5.88 | 3.0 | Comp. ex. |
| 0.01 | 0.02 | 0.88 | 5.44 | 0.7 | Inv. |
| 0.1 | 0.08 | 0.84 | 5.55 | 0.6 | Inv. |
| 0.2 | 0.15 | 0.83 | 5.38 | 0.4 | Inv. |
| 1 | 60 | 0.81 | 5.30 | 0.1 | Inv. |
| 5 | 300 | 0.88 | 5.45 | 0.5 | Inv. |
| 10 | 990 | 0.89 | 5.55 | 0.8 | Inv. |
| 15 | 1300 | 0.95 | 5.90 | 1.5 | Comp. ex. |

Example 3

A steel slab containing the chemical ingredients shown in Table 3 was hot rolled to a thickness of 2.0 mm. The hot rolled steel plate was annealed at 1120° C. for 1 minute. After this, it was rolled by cold rolling to a final plate thickness of 0.23 mm.

Furthermore, the obtained strip was decarburization annealed at a uniform temperature of 835° C. in wet hydrogen. An annealing separator having MgO as its main ingredient and containing $CeO_2$ and $TiO_2$ of a mean grain size of 14 μm and BET specific surface area of 8 $m^2/g$ in amounts, converted to Ce and Ti shown in Table 5, was coated, then the strip was treated to remove the moisture in the MgO at 700° C.×20 h, then annealed at a high temperature at 1200° C. for 20 hours in a hydrogen gas atmosphere. The excess MgO of the obtained steel plate was removed, then the formed forsterite coating was formed with an insulating coating having colloidal silica and a phosphate as its main ingredients to obtain the final product. The characteristics of the obtained product are shown in Table 5.

The steel plate satisfying the conditions of the present invention forms oriented magnetic steel plate with excellent coating adhesion, edge peeling resistance, and magnetic characteristics.

TABLE 5

| Am't of Ce ($CeO_2$) added (%) | Ce areal weight ($mg/m^2$) | Am't of Ti($TiO_2$) added (%) | Ti areal weight ($mg/m^2$) | Watt loss $W_{17/50}$ (W/kg) | Watt loss $W_{17/150}$ (W/kg) | Edge peeling resistance (mm) | Remarks |
|---|---|---|---|---|---|---|---|
| 0 | 0 | 0 | 0 | 0.85 | 5.88 | 3.0 | Comp. ex. |
| 1 | 231 | 0 | 0 | 0.87 | 5.51 | 0.6 | Inv. |
| 1 | 205 | 0.3 | 4 | 0.84 | 5.42 | 0.4 | Inv. |
| 1 | 111 | 0.6 | 9 | 0.86 | 5.43 | 0.2 | Inv. |
| 1 | 52 | 1.2 | 44 | 0.82 | 5.32 | 0.1 | Inv. |
| 1 | 42 | 3 | 88 | 0.83 | 5.29 | 0.0 | Inv. |
| 1 | 33 | 6 | 180 | 0.84 | 5.37 | 0.1 | Inv. |
| 1 | 35 | 10 | 250 | 0.82 | 5.45 | 0.0 | Inv. |
| 10 | 850 | 10 | 250 | 0.86 | 5.56 | 0.2 | Inv. |
| 15 | 1600 | 10 | 244 | 0.93 | 6.09 | 1.5 | Comp. ex. |

Example 4

Steels of the ingredients shown in Table 6-1 and Table 6-2 were produced in a 200 ton converter, cast into ingots of a size of 10 tons, then heated to 1200° C. and bloomed to form slab-like hot rolling materials of a thickness of 200 mm, width of 800 mm, and length of 800 mm. These were heated at 1350° C. for 1 hour, then rolled by tandem hot rolling mills to plate thicknesses of 2.2 mm. These were then annealed at 1095° C. for 2 minutes, then cooled by aerated water in a nitric acid bath to remove the oxide scale, cold rolled by a Sendzimir cold rolling mill for 5 passes over about 1 hour to a plate thickness of down to 0.27 mm, annealed in a wet hydrogen-nitrogen mixed atmosphere at 835° C. for 2.5 minutes, then formed with an oxide film on the steel plate surface.

TABLE 6-1

| Code | C | Si | Mn | S | Se | Sol-Al | N | Bi |
|---|---|---|---|---|---|---|---|---|
| A | 0.05 | 3.4 | 0.10 | 0.020 | 0.005 | 0.025 | 0.007 | 0.002 |
| B | 0.07 | 1.8 | 0.11 | 0.022 | 0.0001 | 0.027 | 0.008 | 0.006 |
| C | 0.11 | 2.5 | 0.05 | 0.020 | 0.010 | 0.020 | 0.010 | 0.003 |
| D | 0.08 | 4.5 | 0.07 | 0.020 | 0.030 | 0.030 | 0.011 | 0.015 |
| E | 0.07 | 3.8 | 0.03 | — | 0.035 | 0.035 | 0.005 | 0.001 |
| F | 0.06 | 2.9 | 0.25 | 0.014 | — | 0.017 | 0.009 | 0.030 |
| G | 0.06 | 7.1 | 0.25 | 0.014 | — | 0.017 | 0.009 | 0.020 |
| H | 0.03 | 2.6 | 0.04 | 0.012 | 0.013 | 0.070 | 0.010 | 0.011 |
| I | 0.08 | 3.1 | 0.08 | 0.026 | 0.005 | 0.008 | 0.010 | 0.004 |
| J | 0.04 | 3.3 | 0.09 | 0.007 | 0.018 | 0.030 | 0.018 | 0.006 |
| K | 0.06 | 3.6 | 0.018 | 0.020 | 0.008 | 0.024 | 0.007 | 0.008 |
| L | 0.09 | 3.0 | 0.06 | — | — | 0.031 | 0.006 | 0.0008 |

TABLE 6-2

| Code | Sn | Cu | Sb | As | Mo | Cr | P | Ni | B | Te | Pb | V | Ge | Base |
|---|---|---|---|---|---|---|---|---|---|---|---|---|---|---|
| M | 0.04 | | | | | | | | | | | | | A |
| N | 0.02 | | | 0.06 | | | | | | | | | | A |
| O | 0.60 | | | | | | | | | | | | | A |
| P | | 0.4 | | | | | | 0.2 | | | | | | A |
| Q | | 0.2 | | | | | | | | | | | | A |
| R | | | | | | | | | | | | | | A |
| S | 0.05 | | 0.06 | | | | | | | | | | | A |
| T | | | | | 0.4 | | | | | | | | | E |
| U | | | | | 0.7 | | | | | | | | | E |
| V | | | | | | | | | | 0.003 | | | | E |
| W | | | | | | | | | | 0.002 | | | 0.1 | E |
| X | | | | | | | | | | | | 0.02 | | E |
| Y | | | | | | | | 0.1 | | | 0.05 | | | E |
| Z | | | | | | | | | 0.004 | | | | | F |
| AA | | | | | | | 0.2 | | | | | | | F |
| AB | | | | 0.7 | | | | | | | | | | F |
| AC | | | 0.05 | | | 0.1 | | | | | | | | F |
| AD | | 0.3 | | | | 0.3 | | | | | | | | F |
| AE | | | | | | | | | | | | 0.003 | | F |
| AF | | | | | | | | | | | | | 0.003 | F |

After this, powders comprising magnesium oxide of a mean grain size of 0.2 μm into which additives shown by the compositions of A and B in Table 7 were mixed were dissolved in industrial use pure water to form slurries. The slurries were coated by roll coaters on the steel plates and dried at 400° C., then the steel plates were wound up in tight coils in the state with the magnesium oxide powder attached, then heated in a mixed atmosphere of hydrogen and nitrogen by gas heating to 1200° C. and held for 1 day. The heating was then stopped and the plates cooled to room temperature.

Table 8 and Table 9 show the results of evaluation of the magnetism and evaluation of the frame permeability by the Epstein method together with the Ce areal weight in the steel plate for steel plate after cooling, rinsing off the magnesium oxide and compounds reacting with the steel ingredients adhering to the steel plate surface, and drying. Note that the material codes M to AF evaluate the uniformity of characteristics over the entire length and entire width of a coil when additionally added to the materials of the codes A, E, and F. That is, the parts not giving the magnetic characteristics which should inherently be obtained in strip steel plate sometimes cause a drop in the yield. The amounts are evaluated by the area ratio of parts of $B_8 \geqq 1.93$ T or more in the obtained steel plate.

In each case, it is clear that when the conditions of the steel ingredients of the present invention are not satisfied, the magnetic characteristics deteriorate or steel plate having a high surface area of $B_8 \geqq 1.93$ T or more cannot be obtained.

TABLE 7

| | |
|---|---|
| i | $Ce(OH)_4$: 3% |
| ii | $Ce(SO_4)_2$: 1%, $TiO_2$: 6%, $SrSO_4$: 0.5% |

TABLE 8

| Sample code | | Ce areal weight ($mg/m^2$) | Watt loss $W_{17/50}$ (W/kg) | Watt loss $W_{17/150}$ (W/kg) | Edge peeling resistance (mm) | Remarks |
|---|---|---|---|---|---|---|
| A | i | 2 | 0.90 | 5.93 | 0.1 | Inv. |
| | ii | 1 | 0.89 | 5.45 | 0.0 | Inv. |
| B | i | 3 | 1.53 | 6.75 | 0.2 | Inv. |
| | ii | 2 | 1.31 | 6.81 | 0.2 | Inv. |
| C | i | 4 | 1.38 | 6.93 | 0.5 | Comp. ex. |
| | ii | 2 | 1.43 | 6.86 | 0.3 | Comp. ex. |
| D | i | 5 | 1.52 | 6.91 | 0.4 | Comp. ex. |
| | ii | 2 | 1.55 | 7.01 | 0.1 | Comp. ex. |
| E | i | 3 | 0.86 | 5.42 | 0.2 | Inv. |
| | ii | 1 | 0.88 | 5.41 | 0.4 | Inv. |
| F | i | 10 | 0.92 | 5.52 | 0.3 | Inv. |
| | ii | 9 | 0.91 | 5.48 | 0.5 | Inv. |
| G | i | Steel plate broke during rolling, so characteristics | | | | Comp. ex. |
| | ii | could not be evaluated | | | | Comp. ex. |
| H | i | 15 | 1.93 | 7.11 | 2.0 | Comp. ex. |
| | ii | 11 | 1.76 | 7.02 | 3.0 | Comp. ex. |
| I | i | 5 | 1.85 | 6.96 | 0.2 | Comp. ex. |
| | ii | 7 | 1.61 | 6.83 | 0.3 | Comp. ex. |

TABLE 8-continued

| Sample code | | Ce areal weight ($mg/m^2$) | Watt loss $W_{17/50}$ (W/kg) | Watt loss $W_{17/150}$ (W/kg) | Edge peeling resistance (mm) | Remarks |
|---|---|---|---|---|---|---|
| J | i | 4 | 1.48 | 6.75 | 0.1 | Comp. ex. |
| | ii | 9 | 1.52 | 6.84 | 0.5 | Comp. ex. |
| K | i | 8 | 1.63 | 7.04 | 0.3 | Comp. ex. |
| | ii | 4 | 1.73 | 6.65 | 0.0 | Comp. ex. |
| L | i | 6 | 1.56 | 6.91 | 0.2 | Comp. ex. |
| | ii | 10 | 1.81 | 6.88 | 0.1 | Comp. ex. |

TABLE 9

| Sample code | | Area ratio of $B_8$ ≧1.93 T or more | Remarks | |
|---|---|---|---|---|
| M | i | 98.5% | | Inv. |
| | ii | 99.1% | | Inv. |
| N | i | 98.3% | | Inv. |
| | ii | 98.7% | | Inv. |
| O | i | 91.4% | Edge peeling 2 mm | Comp. ex. |
| | ii | 92.1% | Edge peeling 3 mm | Comp. ex. |
| P | i | 98.0% | | Inv. |
| | ii | 99.2% | | Inv. |
| Q | i | 99.5% | | Inv. |
| | ii | 98.9% | | Inv. |
| R | i | 98.8% | | Inv. |
| | ii | 99.2% | | Inv. |
| S | i | 98.9% | | Inv. |
| | ii | 99.0% | | Inv. |
| T | i | 99.2% | | Inv. |
| | ii | 98.7% | | Inv. |
| U | i | 90.8% | | Comp. ex. |
| | ii | 89.4% | | Comp. ex. |
| V | i | 98.6% | | Inv. |
| | ii | 99.1% | | Inv. |
| W | i | 99.2% | | Inv. |
| | ii | 98.8% | | Inv. |
| X | i | 98.6% | | Inv. |
| | ii | 99.0% | | Inv. |
| Y | i | 99.4% | | Inv. |
| | ii | 99.1% | | Inv. |
| Z | i | 98.7% | | Inv. |
| | ii | 98.9% | | Inv. |
| AA | i | 99.2% | | Inv. |
| | ii | 98.7% | | Inv. |
| AB | i | 91.0% | | Comp. ex. |

TABLE 9-continued

| Sample code | | Area ratio of $B_8$ ≧1.93 T or more | Remarks |
|---|---|---|---|
| | ii | 90.2% | Comp. ex. |
| AC | i | 98.4% | Inv. |
| | ii | 98.3% | Inv. |
| AD | i | 99.7% | Inv. |
| | ii | 99.3% | Inv. |
| AE | i | 98.6% | Inv. |
| | ii | 98.8% | Inv. |
| AF | i | 99.0% | Inv. |
| | ii | 98.7% | Inv. |

Example 5

A steel slab comprising, by mass %, C: 0.08%, Si: 3.3%, Mn: 0.075%, S: 0.024%, acid soluble Al: 0.024%, N: 0.008%, Sn: 0.1%, Cu: 0.1%, Bi: 0.0055%, and the balance of Fe was heated at 1350° C., then hot rolled to a thickness of 2.3 mm. The hot rolled plate was then annealed at 1120° C. for 1 minute. After this, the plate was cold rolled to a final plate thickness of 0.23 mm. The obtained strip was raised in temperature to 850° C. by a 300° C./s electric heating method, then was decarburization annealed in wet hydrogen at 830° C. for 2 minutes. After this, it was coated with an annealing separator comprising MgO to which the additives shown in Table 9 (mass %) were added and annealed at a high temperature at a maximum peak temperature of 1200° C. for 20 hours in a hydrogen gas atmosphere. This was rinsed, then coated and baked with an insulating film having aluminum phosphate and colloidal silica as its main ingredients, then lasered to subdivide the magnetic domains. The characteristics and edge peeling resistance of the obtained product plate are shown in Table 10. Further, before coating the insulating coating, a Matsuzawa Seiki Vicker's hardness tester (Model: DMH-2LS) was used to obtain the microVicker's hardness (Hv) from the pressure mark area at the time of a load of 2 g. This is also shown in Table 11.

A coil satisfying the conditions of the present invention forms oriented magnetic steel plate with excellent coating adhesion, in particular, edge peeling resistance, and magnetic characteristics.

TABLE 10

| Sample code | Additive ingredient: X-based ingredient | Am't of X added (%) | Ti-based ingredient | Am't of Ti added (%) | Y-based ingredient | Am't of Y added (%) |
|---|---|---|---|---|---|---|
| 1 | $La_2O_3$ | 3.0 | $Ti_2O_3$ | 7 | $Y_2(SO_4)_3$ | 3.0 |
| 2 | $La(OH)_3$ | 1.0 | $TiO_2$ | 2 | $SrSO_4$ | 3.0 |
| 3 | $La_2SO_4 \cdot 7H_2O$ | 3.0 | None | 0 | None | 0.0 |
| 4 | $Pr_6O_{11}$ | 8.0 | None | 0 | $Ca(OH)_2$ | 2.0 |
| 5 | $Pr_2(SO_4)_3 \cdot 8H_2O$ | 2.0 | $Ti_2O_3$ | 3 | $CaSO_4 \cdot 2H_2O$ | 5.0 |
| 6 | $Nd_2O_3$ | 0.5 | $TiO_2$ | 10 | $Ca(CO_3)_2$ | 10.0 |
| 7 | $Nd_2(SO_4)_3 \cdot 5H_2O$ | 10.0 | $Ti_2O_3$ | 2 | $Ba(OH)_2$ | 2.0 |
| 8 | $Nd(NO_3)_3$ | 1.0 | $TiO_2$ | 5 | $BaSO_4$ | 8.0 |
| 9 | $Sc_2O_3$ | 0.1 | $TiO_2$ | 2 | $Ba(CO_3)_2$ | 4.0 |
| 10 | $Y_2O_3$ | 8.0 | $TiO_2$ | 8 | $CaSO_4 \cdot 2H_2O$ | 1.0 |
| 11 | $Y_2(SO_4)_3$ | 0.2 | $TiO_2$ | 1 | $Sr(OH)_2$ | 1.0 |
| 12 | $CeO_2$ | 2.0 | $TiO_2$ | 6 | $CaSO_4 \cdot 2H_2O$ | 0.2 |
| 13 | $Ce(OH)_4$ | 1.0 | $TiO_2$ | 3 | $SrSO_4$ | 2.0 |
| 14 | $Ce(SO_4)_2 \cdot 4H_2O$ | 0.5 | $Ti_2O_3$ | 2 | $Ca(OH)_2$ | 3.0 |
| 15 | $Ce(OH)_4$ | 2.0 | $Ti_2O_3$ | 1 | $BaSO_4$ | 4.0 |
| 16 | $CeO_2$ | 20.0 | $TiO_2$ | 2 | $Y_2O_3$ | 8.0 |
| 17 | None | 0.0 | $TiO_2$ | 2 | $Ba(OH)_2$ | 5.0 |
| 18 | None | 0.0 | $TiO_2$ | 2 | None | 0.0 |

TABLE 11

| Sample code | X areal weight ($mg/m^2$) | Ti areal weight ($mg/m^2$) | Y areal weight ($mg/m^2$) | $B_8$ (T) | Watt loss $W_{17/50}$ (W/kg) | Watt loss $W_{17/150}$ (W/kg) | Edge peeling resistance (mm) | Hardness Hv | Remarks |
|---|---|---|---|---|---|---|---|---|---|
| 1 | 33 | 530 | 25 | 1.96 | 0.69 | 4.08 | 0.2 | 10.2 | Inv. |
| 2 | 5 | 55 | 33 | 1.97 | 0.68 | 3.98 | 0.2 | 10.5 | Inv. |
| 3 | 65 | 0 | 0 | 1.95 | 0.71 | 4.11 | 0.3 | 10.2 | Inv. |
| 4 | 220 | 0 | 18 | 1.96 | 0.60 | 4.05 | 0.2 | 9.5 | Inv. |
| 5 | 21 | 94 | 70 | 1.94 | 0.68 | 3.99 | 0.2 | 10.5 | Inv. |
| 6 | 2 | 750 | 93 | 1.95 | 0.71 | 4.06 | 0.4 | 10.8 | Inv. |
| 7 | 460 | 80 | 10 | 1.96 | 0.67 | 3.81 | 0.1 | 9.2 | Inv. |
| 8 | 23 | 170 | 85 | 1.94 | 0.71 | 3.99 | 0.2 | 10.6 | Inv. |
| 9 | 0.05 | 68 | 56 | 1.97 | 0.69 | 3.99 | 0.5 | 11.2 | Inv. |
| 10 | 170 | 76 | 3 | 1.95 | 0.69 | 4.02 | 0.1 | 9.5 | Inv. |
| 11 | 0.6 | 15 | 0.5 | 1.95 | 0.70 | 4.08 | 0.8 | 11.6 | Inv. |
| 12 | 12 | 120 | 0.04 | 1.96 | 0.68 | 3.98 | 0.2 | 10.2 | Inv. |
| 13 | 3 | 48 | 23 | 1.95 | 0.69 | 3.97 | 0.3 | 10.6 | Inv. |
| 14 | 1 | 33 | 33 | 1.96 | 0.67 | 3.83 | 0.4 | 11.5 | Inv. |
| 15 | 10 | 10 | 42 | 1.95 | 0.68 | 4.00 | 0.2 | 10.2 | Inv. |
| 16 | 1200 | 13 | 150 | 1.86 | 0.93 | 5.32 | 1 | 12.2 | Comp. ex. |
| 17 | 0 | 15 | 75 | 1.94 | 0.72 | 4.42 | 5 | 14.5 | Comp. ex. |
| 18 | 0 | 12 | 0 | 1.93 | 0.77 | 4.73 | 15 | 19.3 | Comp. ex. |

Example 6

A steel comprising, by mass %, C: 0.08%, Si: 3.2%, Mn: 0.075%, S: 0.024%, acid soluble Al: 0.023%, N: 0.008%, Sn: 0.1%, and the balance of Fe was heated at 1340° C., then hot rolled to a thickness of 2.3 mm. The hot rolled plate was annealed at 1110° C. for 1 minute. After this, it was rolled by cold rolling to a final plate thickness of 0.23 mm. The obtained strip was raised in temperature to 850° C. by the 300° C./s electric heating method, then decarburization annealed in wet hydrogen at 830° C. for 2 minutes. After this, it was coated with an annealing separator comprising MgO to which the additives shown in Table 12 (mass %) were added and annealed at a high temperature at a maximum peak temperature of 1180° C. for 15 hours in a hydrogen gas atmosphere. This was rinsed, then coated and baked with an insulating film having magnesium phosphate and colloidal silica as its main ingredients, then formed with grooves by gearwheels to subdivide the magnetic domains and stress-relief annealed in nitrogen at 800° C. for 4 hours. The characteristics and edge peeling resistance of the obtained product plate are shown in Table 13.

By satisfying the conditions of the present invention, the coil becomes an oriented magnetic steel plate with excellent edge peeling resistance and magnetic characteristics.

TABLE 12

| | Additive ingredient | | | | | |
|---|---|---|---|---|---|---|
| Sample code | X-based ingredient | Am't of X added (%) | Ti-based ingredient | Am't of Ti added (%) | Y-based ingredient | Am't of Y added (%) |
| 1 | $CeO_2$ | 3 | $TiO_2$ | 3 | $La_2(SO_4)_3 \cdot 7H_2O$ | 0.5 |
| 2 | $Ce(OH)_4$ | 1 | $TiO_2$ | 2 | $CaSO_4 \cdot 2H_2O$ | 0.2 |
| 3 | $Ce(SO_4)_2 \cdot 4H_2O$ | 3 | $TiO_2$ | 1 | $BaSO_4$ | 4.5 |
| 4 | $Ce(SO_4)_2 \cdot 4H_2O$ | 1 | $TiO_2$ | 2 | $La_2O_3$ | 1.0 |
| 5 | $Ce_2O_3$ | 3 | $TiO_2$ | 3 | $CaSO_4 \cdot 2H_2O$ | 3.5 |
| 6 | $La_2O_3$ | 3 | $TiO_2$ | 2 | $BaSO_4$ | 5.0 |
| 7 | $La_2O_3$ | 1 | $TiO_2$ | 1 | $SrSO_4$ | 0.5 |
| 8 | $La_2(SO_4)_3 \cdot 7H_2O$ | 3 | $TiO_2$ | 2 | $CaSO_4 \cdot 2H_2O$ | 5.0 |
| 9 | $La_2(SO_4)_3 \cdot 7H_2O$ | 1 | $TiO_2$ | 3 | $Ba(OH)_2$ | 0.5 |
| 10 | None | 0 | None | 0 | $BaSO_4$ | 5.0 |
| 11 | None | 0 | None | 0 | None | 0.0 |

TABLE 13

| Sample code | X areal weight ($mg/m^2$) | Ti areal weight ($mg/m^2$) | Y areal weight ($mg/m^2$) | $B_8$ (T) | Watt loss $W_{17/50}$ (W/kg) | Watt loss $W_{17/150}$ (W/kg) | Edge peeling resistance (mm) | Remarks |
|---|---|---|---|---|---|---|---|---|
| 1 | 18 | 55 | 2 | 1.89 | 0.80 | 4.73 | 0.1 | Inv. |
| 2 | 3 | 36 | 0.3 | 1.92 | 0.74 | 4.37 | 0.3 | Inv. |
| 3 | 10 | 17 | 45 | 1.93 | 0.73 | 4.31 | 0.2 | Inv. |
| 4 | 4 | 28 | 6 | 1.92 | 0.75 | 4.43 | 0.2 | Inv. |
| 5 | 13 | 72 | 25 | 1.90 | 0.78 | 4.61 | 0.1 | Inv. |
| 6 | 32 | 44 | 60 | 1.89 | 0.79 | 4.70 | 0.1 | Inv. |

TABLE 13-continued

| Sample code | X areal weight ($mg/m^2$) | Ti areal weight ($mg/m^2$) | Y areal weight ($mg/m^2$) | $B_8$ (T) | Watt loss $W_{17/50}$ (W/kg) | Watt loss $W_{17/150}$ (W/kg) | Edge peeling resistance (mm) | Remarks |
|---|---|---|---|---|---|---|---|---|
| 7 | 7 | 20 | 1 | 1.91 | 0.77 | 4.55 | 0.3 | Inv. |
| 8 | 23 | 38 | 56 | 1.93 | 0.73 | 4.31 | 0.1 | Inv. |
| 9 | 5 | 60 | 0.8 | 1.90 | 0.79 | 4.67 | 0.2 | Inv. |
| 10 | 0 | 0 | 65 | 1.93 | 0.73 | 4.31 | 2.0 | Comp. ex. |
| 11 | 0 | 0 | 0 | 1.92 | 0.76 | 4.49 | 2.0 | Comp. ex. |

INDUSTRIAL APPLICABILITY

According to the present invention, the problem of peeling of the surface coating occurring at the time of slit shearing and angular shearing for producing a transformer and the problem of the watt loss characteristic of the material not being able to be sufficiently exhibited when assembled in the transformer are solved and the high efficiency transformer sought by the market can be industrially and stably produced.

The invention claimed is:

1. Oriented magnetic steel plate with excellent coating adhesion comprising an oriented magnetic steel plate produced by a method including the steps of:

annealing a hot rolled oriented magnetic steel plate containing, by mass %, C: 0.10% or less, Si: 1.8 to 7%, Mn: 0.02 to 0.30%, a total of one or more of S and Se: 0.001 to 0.040%, acid soluble Al: 0.010 to 0.065%, N: 0.0030 to 0.0150%, Bi: 0.0005 to 0.05 and the balance of Fe and unavoidable impurities;

cold rolling the annealed steel plate at least once, with process annealing in between cold rolling steps, thereby finishing the plate to a final thickness, decarburization annealing the cold rolled steel plate, then coating the steel plate surface with an annealing separator, drying the annealing separator, and then final annealing the coated steel plate, and a primary coating on the surface of said oriented magnetic steel plate having forsterite as its main ingredient, one or more of Ce, La, Pr, Nd, Sc, and Y in an areal weight per side of 0.001 to 1000 $mg/m^2$, Ti in an areal weight per side of 1 to 800 $mg/m^2$, and one or more of Sr, Ca, and Ba in an areal weight per side of 0.01 to 100 $mg/m^2$.

2. A method of producing an oriented magnetic steel plate excellent in coating adhesion comprising the steps of:

annealing a hot rolled oriented magnetic steel plate comprising, by mass %, C: 0.10% or less, Si: 1.8 to 7%, Mn: 0.02 to 0.30%, a total of one or more of S and Se: 0.001 to 0.040%, acid soluble Al: 0.010 to 0.065%, N: 0.0030 to 0.0150%, Bi: 0.0005 to 0.05, and the balance of Fe and unavoidable impurities, cold rolling the annealed oriented magnetic steel plate one time or two times or more or two times or more with process annealing in between cold rolling steps, thereby finishing the plate to a final thickness, next decarburization annealing the cold rolled steel plate, then coating the steel plate surface with an annealing separator, drying the annealing separator, and then final annealing the coated steel plate;

the annealing separator having

MgO as a main ingredient, and one or more of a Ce compound, La compound, Pr compound, Nd compound, Sc compound, and Y compound converted to metal in the range of 0.01 to 14 mass % with respect to MgO, a Ti compound, wherein the amount of Ti is from 0.5 to 10 mass % with respect to MgO, and one or more of Sr, Ca, and Ba, wherein the amount of metal is from 0.1 to 10 mass % with respect to the mass of MgO.

3. A method of production of oriented magnetic steel plate excellent in coating adhesion as set forth in claim 2 characterized in that said hot rolled oriented magnetic steel plate further contains one or more of Sn, Cu, Sb, As, Mo, Cr, P, Ni, B, Te, Pb, V, and Ge in an amount from 0.003 to 0.5 mass %.

* * * * *